United States Patent [19]

Cox

[11] Patent Number: 4,973,199

[45] Date of Patent: Nov. 27, 1990

[54] OFFSHORE PLATFORM AND METHOD OF ASSEMBLING

[75] Inventor: Bobby E. Cox, Kenner, La.

[73] Assignee: Shell Oil Company, Houston, Tex.

[21] Appl. No.: 458,015

[22] Filed: Dec. 28, 1989

[51] Int. Cl.[5] ..... E02D 21/00

[52] U.S. Cl. ..... 405/204; 405/203; 405/205

[58] Field of Search ..... 405/204, 203, 205, 209, 405/208, 207, 206, 195; 114/265

[56] References Cited

U.S. PATENT DOCUMENTS

| | | | |
|---|---|---|---|
| 2,597,110 | 5/1952 | Lacy | 405/204 |
| 2,941,370 | 6/1960 | Walker | 405/205 X |
| 3,178,892 | 4/1965 | Stimson | 405/206 |
| 3,327,668 | 6/1967 | Schultz | 405/205 X |
| 3,852,969 | 12/1974 | Gibson et al. | 405/204 |
| 3,922,868 | 12/1975 | McDonald et al. | 114/265 X |
| 4,000,624 | 1/1977 | Chow | 405/204 |
| 4,073,155 | 2/1978 | Schiemichen | 405/205 X |
| 4,222,683 | 9/1980 | Schaloske et al. | 405/204 |
| 4,553,878 | 11/1985 | Willemse et al. | 405/203 |
| 4,557,629 | 12/1985 | Meek et al. | 405/204 |

FOREIGN PATENT DOCUMENTS 2168098A 6/1986 United Kingdom .

*Primary Examiner*—Dennis L. Taylor

[57] ABSTRACT

The present invention is of a deepwater platform which incorporates a central two-piece tower extending from the ocean floor to at least a few feet above the ocean surface. The central tower is divided into an upper tower section and a lower tower section, with the lower tower section being substantially higher than the upper tower section. The tops of outwardly and downwardly positioned struts are connected to the tower at the dividing point between the upper and lower tower sections. Both the lower end of the central tower and the lower ends of the struts are anchored to the ocean floor by driving piles through pile sleeves secured thereto. The dividing line between the upper tower section and the lower tower section depends upon the angle at which the struts are positioned against the tower.

25 Claims, 8 Drawing Sheets

FIG. 1
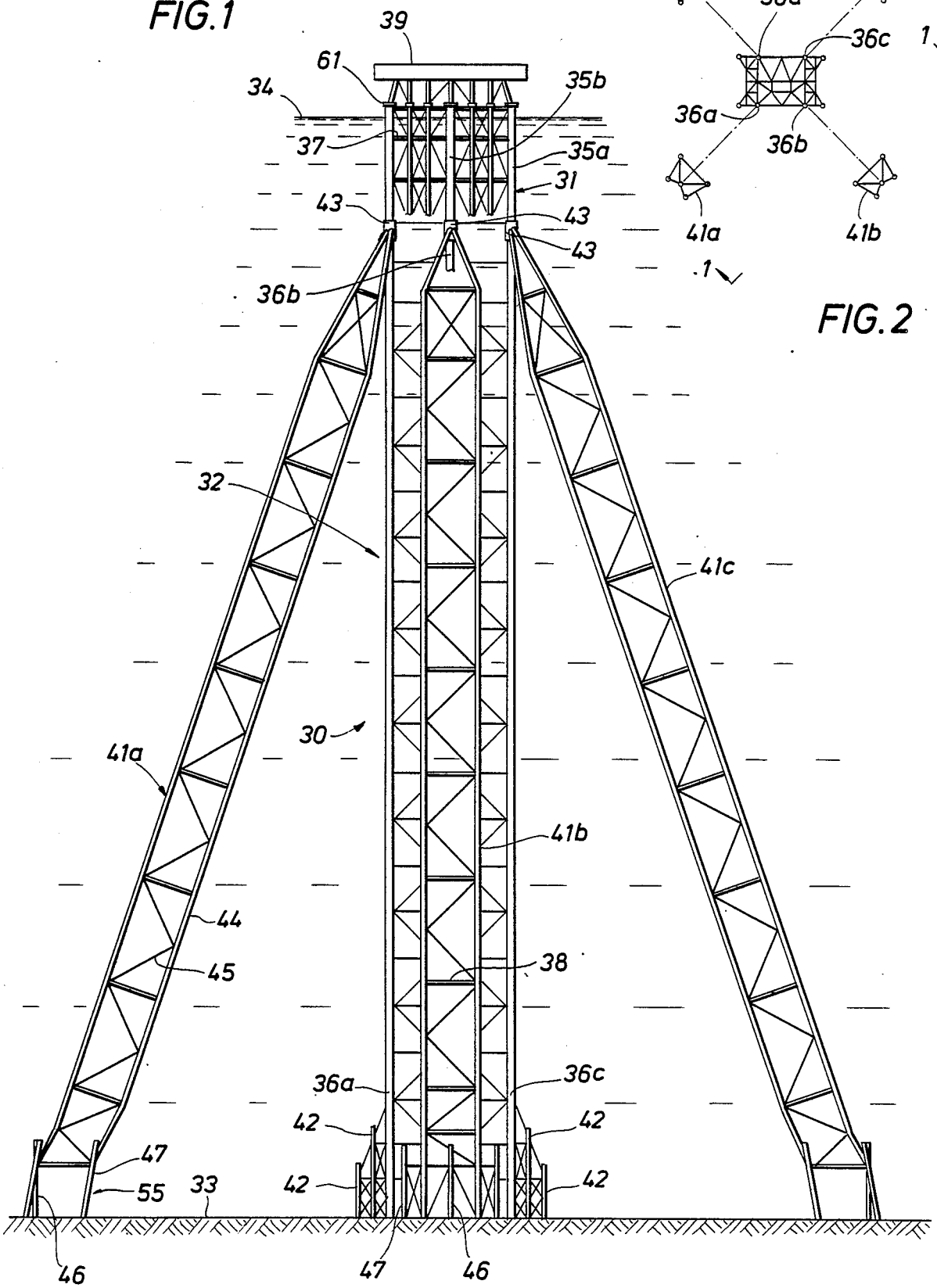
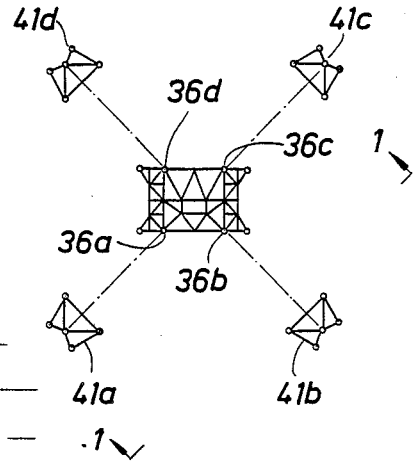
FIG. 2

FIG. 14
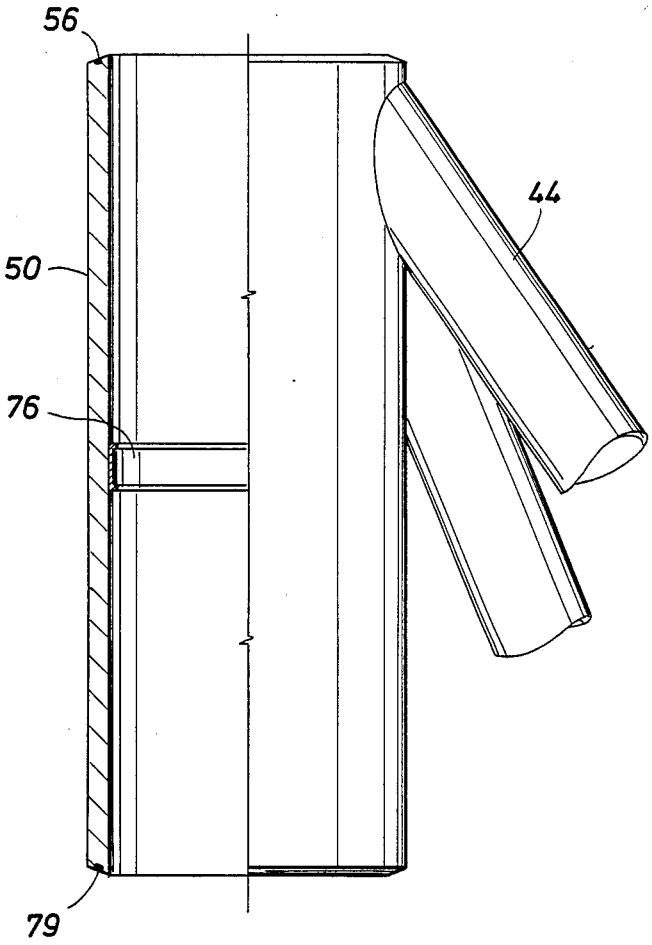
FIG. 18
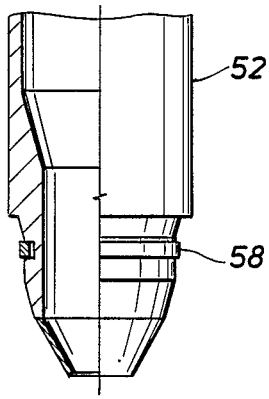
FIG. 17
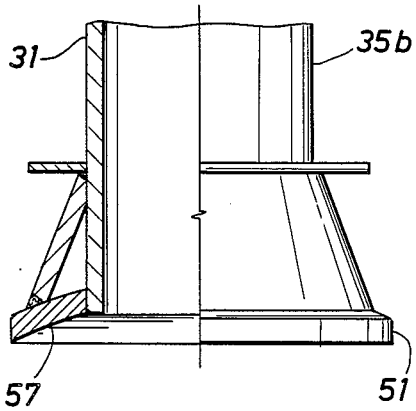
FIG. 15
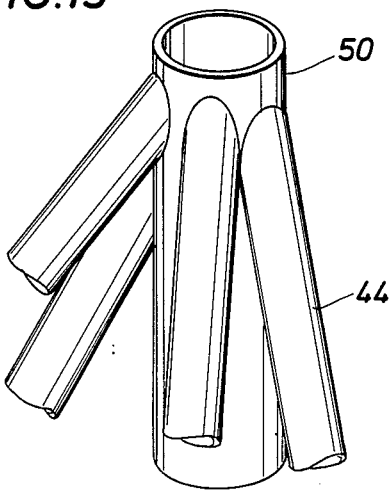
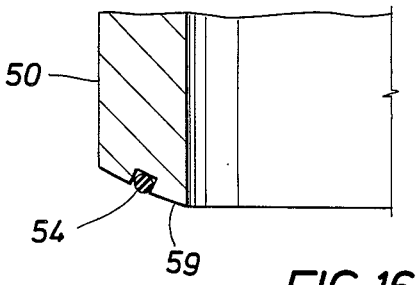
FIG. 16

FIG. 19
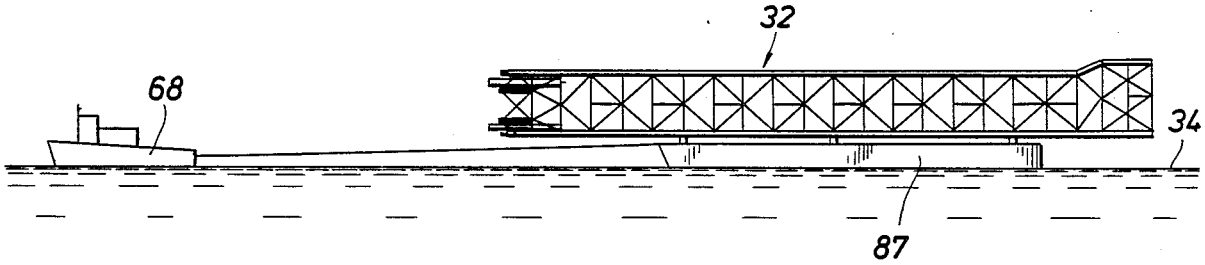
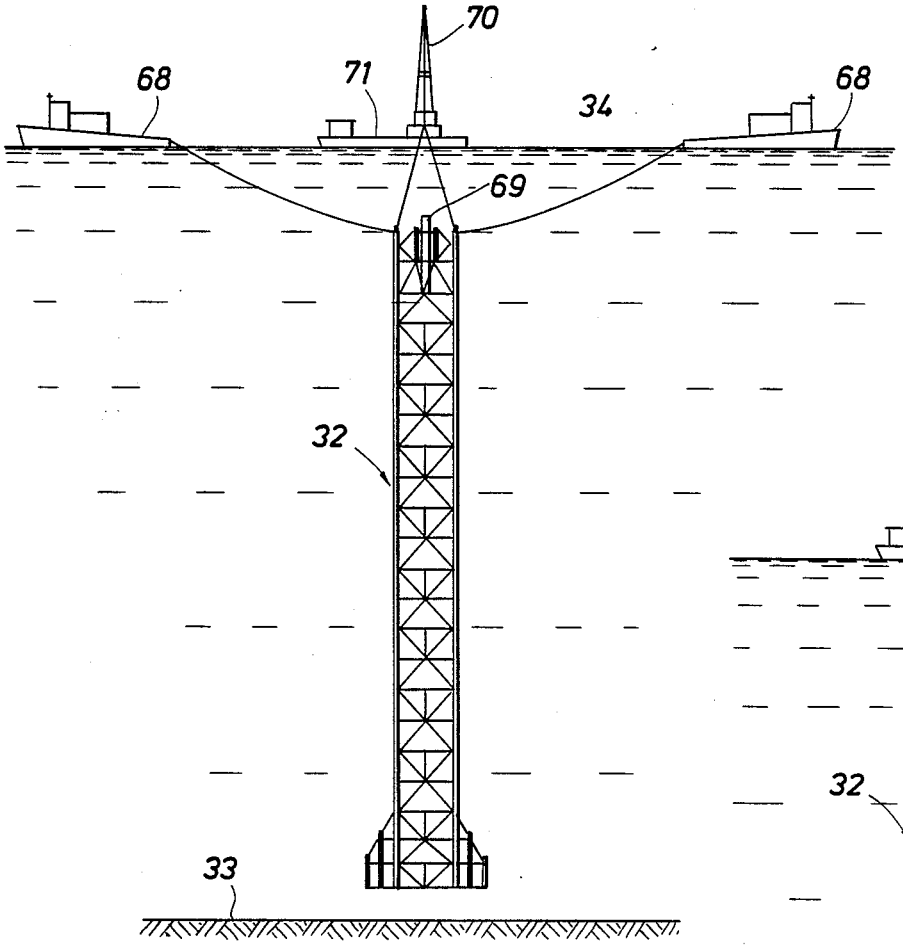
FIG. 20
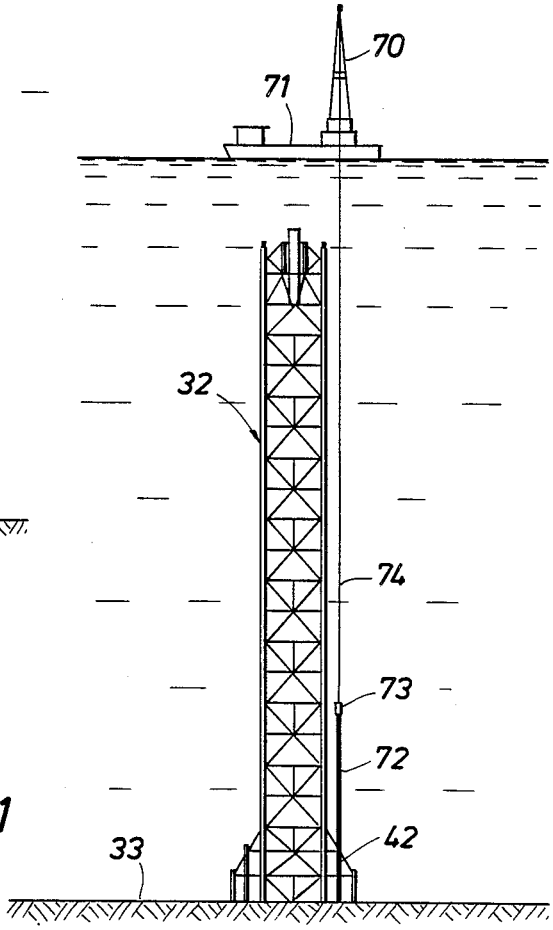
FIG. 21

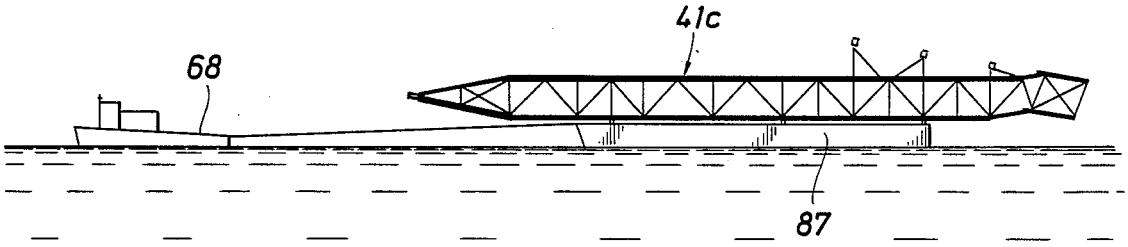
FIG. 22
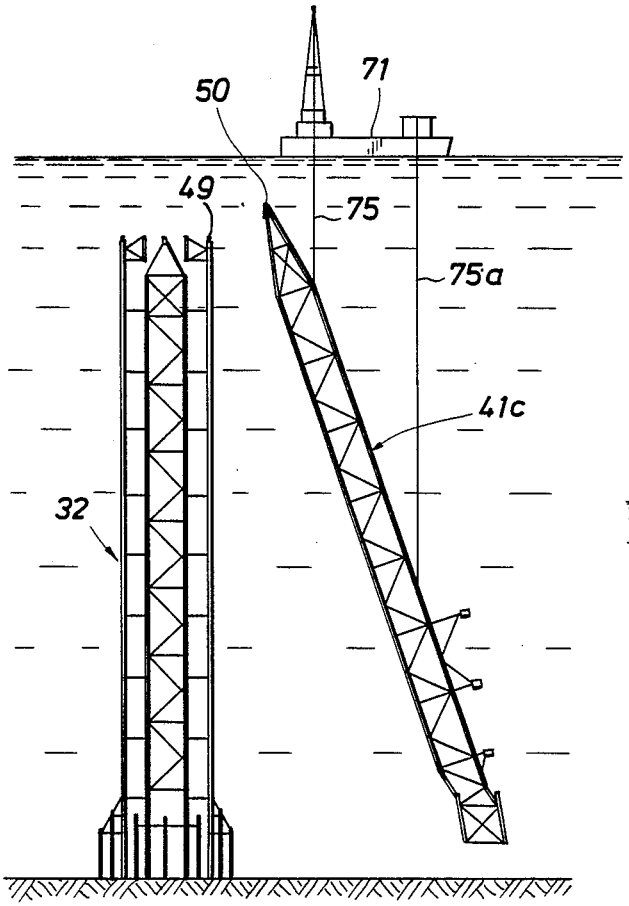
FIG. 23
FIG. 24
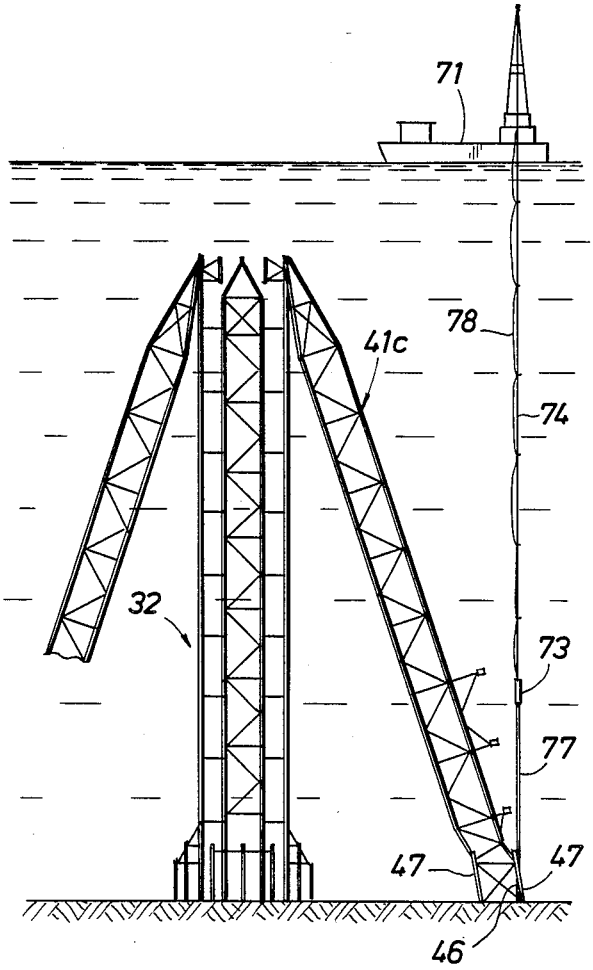

OFFSHORE PLATFORM AND METHOD OF ASSEMBLING

This invention relates to an offshore platform for supporting deepwater marine oil field drilling and production equipment in water depths of 2,000 feet or more. The platform makes use of a two-piece central tower which is supported by three or more struts or legs extending outwardly and downwardly to the ocean floor from the connection point between the upper and lower tower sections.

BACKGROUND OF THE INVENTION

From time to time, offshore structures in the form of large offshore platforms are erected on the ocean floor for drilling wells in the development of oil and gas formations. The majority of offshore platforms that have been built and are in use today have been fabricated as single-piece units. One-piece platforms have been constructed for use in waters up to 1353 feet. However, it is necessary to build a special barge on which the platform rests when it is towed to its location offshore to move a platform structure of this length. Because of the weight and size of these large one-piece structures, it has been found desirable to design lighter structures having a central tower and having a plurality of supporting struts which extend from the central platform or working deck of the structure down to the ocean floor. Such structures are well known to the art and have been disclosed in U.S. Pat. Nos. 3,852,969 to Gibson et al; 2,597,110 to Lacy; 3,178,892 to Stimson; 4,557,629 to Meek et al; and 4,553,878 to Willemse et al. In many of these structures, the legs or struts supporting the platform above the surface of the water extend upwardly through the water surface and are hinged or otherwise connected to the platform. This brings the upper ends of all of the legs or struts into the wave action at the surface, thereby increasing the stress and corrosion problems on the platform. Other known structures that connect the central column to downwardly supporting struts have a base member or mat on the ocean floor that rigidly connects the lower ends of all the struts together and to the central column passing down through the struts.

SUMMARY OF THE INVENTION

The present invention is directed to the design and construction of a deepwater platform which may be used in water depths of 2,000 feet or more. The platform of the present invention incorporates a central two-piece tower extending from the ocean floor to at least a few feet above the ocean surface. The central tower is divided into an upper tower section and a lower tower section, with the lower tower section being substantially higher than the upper tower section. The tops of outwardly and downwardly positioned struts are connected to the tower at the dividing point between the upper and lower tower sections. Both the lower end of the central tower and the lower ends of the struts are anchored to the ocean floor by driving piles through pile sleeves secured thereto. The dividing line between the upper tower section and the lower tower section depends upon the angle at which the struts are positioned against the tower.

For purposes of illustration, the present invention will be described with regard to a tower designed for 2,000 feet of water with the dividing line between the upper tower section and the lower tower section being at about the 200-foot level in the water. In the example given, the center lines of the struts at the ocean floor are about 600 feet from the center line of the tower.

Assembly of the present offshore platform is carried out one piece at a time. The lower tower section is first anchored to the ocean floor and the individual struts are then transported to the tower and lowered so that the top of a strut stabs on the top of a leg of the lower tower section slightly before the time at which the bottom of the strut seats on the ocean floor. Subsequently, the upper tower section is lowered onto the lower tower section and then a deck section of the platform is installed by lowering and connecting it to the top of the tower.

BRIEF DESCRIPTION OF THE DRAWINGS

The present invention will be described herein with regard to the drawings wherein:

FIG. 1 is a side elevational view of a completed platform constructed in accordance with the present invention, illustrated installed upon the ocean floor;

FIG. 2 is a plan view at the ocean floor of the position of the base of the struts of the platform illustrated in FIG. 1 relative to the base of the tower;

FIG. 14 is a longitudinal view taken in partial cross-section of a strut connector sleeve for use in constructing a platform in accordance with the present invention;

FIG. 15 is an isometric view of the strut sleeve of FIG. 14;

FIG. 16 is a view taken in cross-sectional detail of the upper or lower edge of the connector sleeve of FIG. 14;

FIG. 17 is a longitudinal view taken in partial cross-section of a seating shoulder means carried at the bottom of a leg of the upper tower section for use in a platform constructed in accordance with the present invention;

FIG. 18 is a longitudinal view taken in partial cross-section of the lower end of a locking pin adapted to pass through a leg of the upper tower section and lock onto the top of the strut connector pole during construction of a platform in accordance with the present invention;

FIG. 19 is a diagrammatic view illustrating the lower tower section of a platform in accordance with the present invention as loaded on a barge and being towed to a selected location offshore;

FIG. 20 is a diagrammatic view taken in longitudinal section showing the lower tower section being lowered to the ocean floor from a derrick barge;

FIG. 21 is a diagrammatic longitudinal view illustrating the pile driving operations being carried out from the barge to anchor the lower end of the lower tower section to the ocean floor;

FIG. 22 is a diagrammatic view illustrating a strut of a platform in accordance with the present invention as loaded on a barge and being towed to sea;

FIG. 23 is a diagrammatic view taken in longitudinal section illustrating a derrick barge lowering a strut onto the tower section and ocean floor;

FIG. 24 is a diagrammatic longitudinal view illustrating pile driving operations being carried out from the barge to anchor the foot of the strut to the ocean floor;

DESCRIPTION OF A PREFERRED EMBODIMENT

Figure 3:
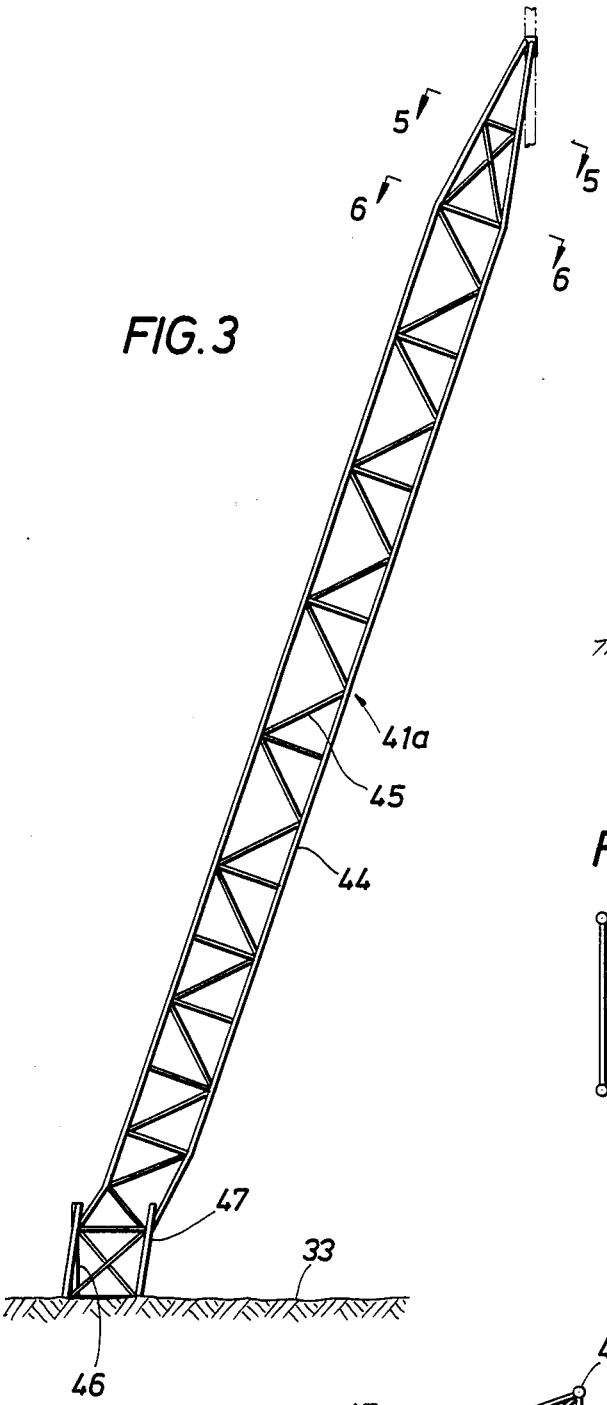
FIG. 3 is a side elevational view of one strut of a platform constructed in accordance with the present invention, the strut being illustrated in the position it assumes when in contact with the ocean floor.

Referring to FIG. 1 of the drawings, the platform of the present invention is shown as having a central tower 30 made up of an upper tower section 31 and a lower tower section 32. The bottom of the lower tower section rests on the ocean floor 33 while the top of the upper tower section 31 is above the water surface 34.

The upper tower section 31 is made up of at least three and preferably four vertical legs 35, here 35*a*, 35*b*, 35*c*, and 35*d*, which are connected together by suitable cross-bracing 37 in a manner well known to the art. In the preferred embodiment, upper tower section 31 is about 200 feet in height. The spacing between the legs of the upper tower section is identical to the spacing of the legs 36*a*, 36*b*, 36*c*, and 36*d* which make up the lower tower section. It is to be understood that the legs of the lower tower section are provided with cross-bracing members 38. The platform is provided with a platform deck section 39 which is adapted to be lowered and seated on the legs of upper tower section 31 and connected thereto in a manner well known to the art. The lower end of lower tower section 32 is provided with a series of pile sleeves 42 which are adapted to receive the lower end of a pile and have the pile driven therethrough into ocean floor 33. The pile is then grouted to secure its reception within the pile sleeve.

Lateral support is provided to central tower 30 by means of a series of outwardly and downwardly sloping struts 41*a*, 41*b*, 41*c*, and 41*d*. Strut 41*a* is illustrated in the form of an elongated lattice framework made up of longitudinal members 44 and cross-bracing members 45. Footing 55 of each strut is secured to the ocean floor with a plurality of pile sleeves 46 and 47 through which piles are driven. In the preferred embodiment, one of the pile sleeves, pile sleeve 46, is vertically oriented while the rest of the pile sleeves 47 are oriented at batter. The upper end of each strut is provided with a strut connector 43 adapted to secure the upper end of the strut to the upper end of a corner leg of lower tower section 32.

Figure 4:
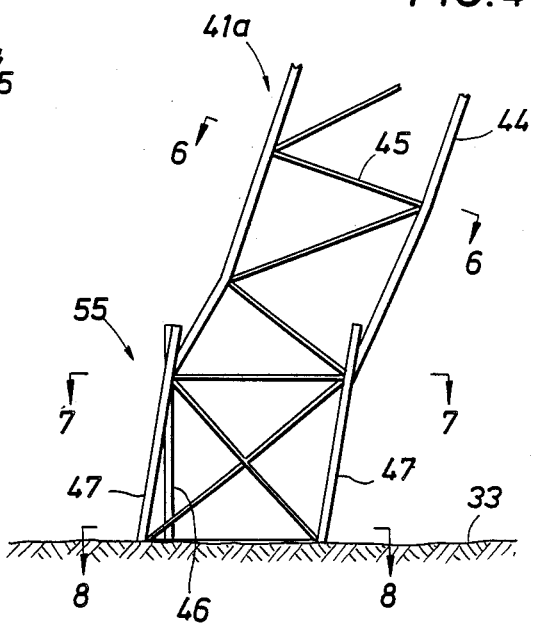
FIG. 4 is a side elevational view of the footing of the strut of FIG. 3 illustrating the anchoring pile sleeves.
Figure 5:
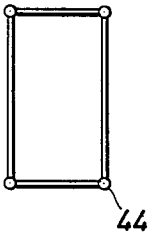
FIG. 5 is a cross-sectional view taken along line 5—5 of FIG. 3.
Figure 6:
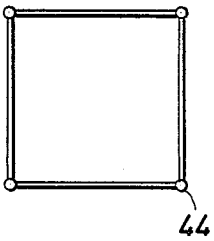
FIG. 6 is a cross-sectional view taken along line 6—6 of both FIGS. 3 and 4.
Figure 7:
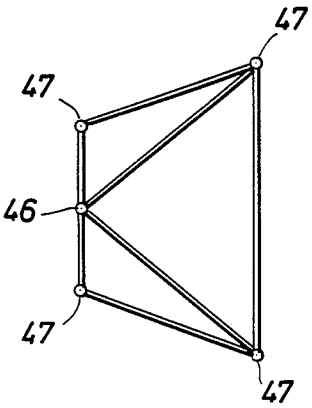
FIG. 7 is a cross-sectional view taken along line 7—7 of FIG. 4.
Figure 8:
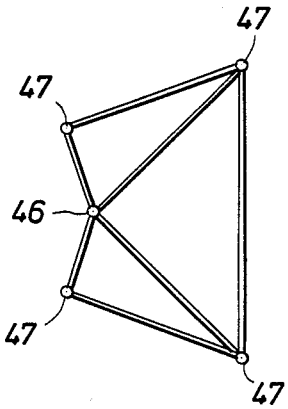
FIG. 8 is a cross-sectional view taken along line 8—8 of FIG. 4.

FIGS. 3–4 illustrate strut 41*a* of FIG. 1 in greater detail and cross-sections of the strut taken at planes designated in FIG. 3 produce FIGS. 5 and 6, while cross-section of the footing 55 taken at the planes designated in FIG. 4 produce FIGS. 7 and 8.

Figure 9:
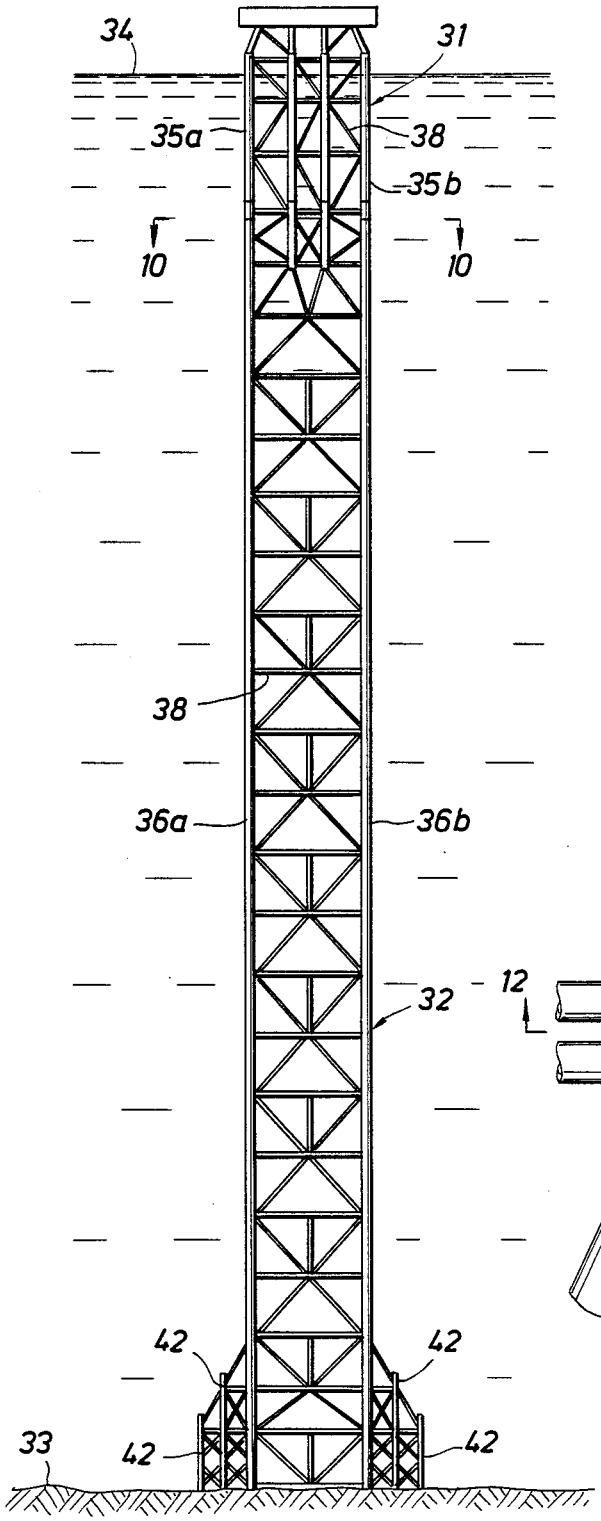
FIG. 9 is a side elevational view of the central tower of the present invention when positioned on the ocean floor in which the struts have been deleted for purposes of clarity in the illustration.
Figure 10:
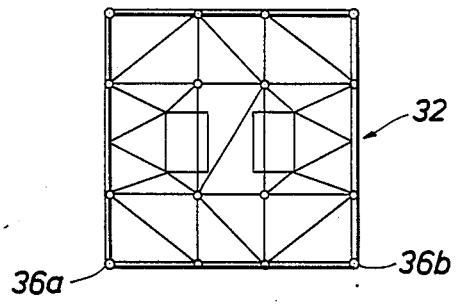
FIG. 10 is a cross-sectional view taken along line 10—10 of FIG. 9.
Figure 11:
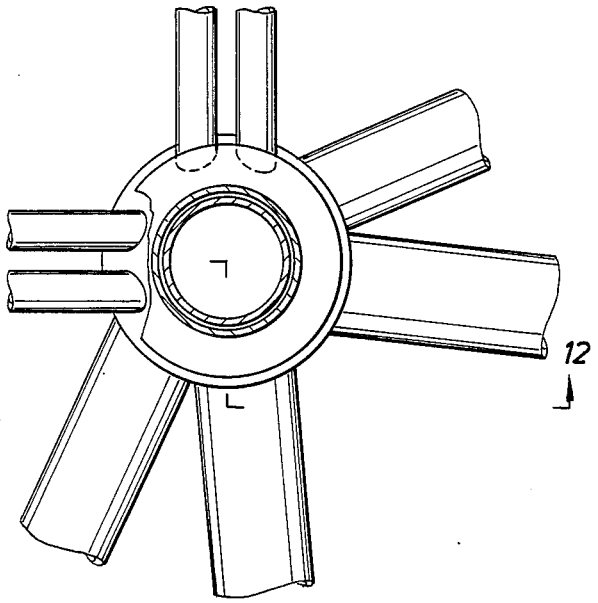
FIG. 11 is a plan view taken in partial cross-section of the tower-to-strut connector on one corner leg of the platform of FIG. 10 in which portions of the strut have been deleated for the drawing.

FIG. 9 of the drawings illustrates the tower viewed at a 45° angle with respect to the vantage point of FIG. 1 and FIG. 10 shows a plan view of lower tower section 32 prior to installing strut 41*b* on leg 36*b*. With the strut and its connector installed at this point, a cross-sectional view is shown in FIG. 11.

Figure 12:
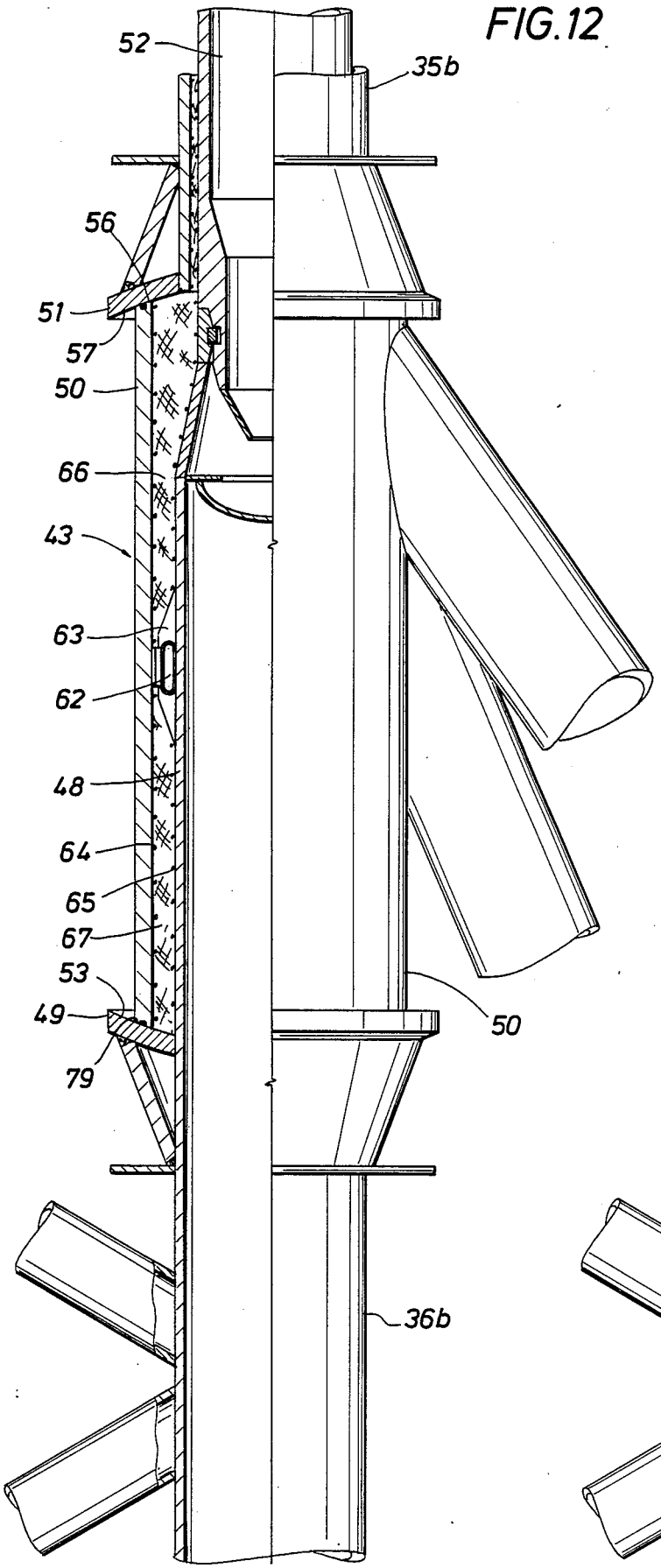
FIG. 12 is a longitudinal view taken in partial cross-section of the tower-to-strut connector of FIG. 11 taken long the line 12—12.
Figure 13:
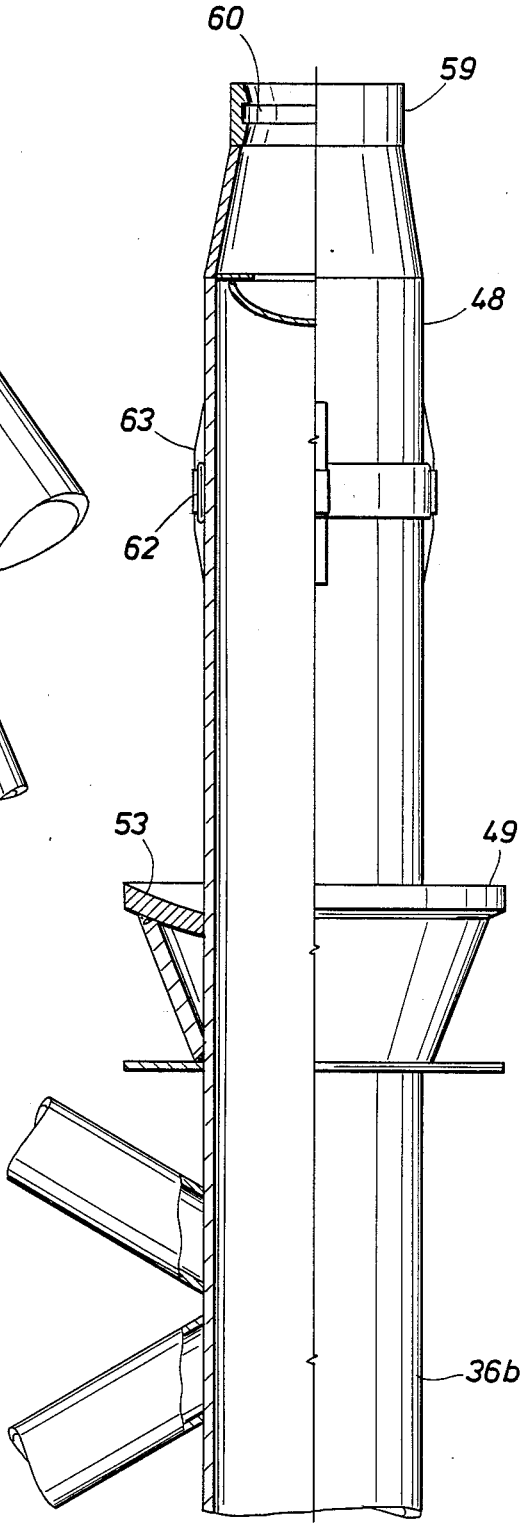
FIG. 13 is a longitudinal view taken in partial cross-section of a strut connector pole for use in constructing a platform in accordance with the present invention.

The configuration and details of strut connector 43 and the preferred embodiment of the means for connecting the strut connector sleeve of the reinforcing strut to the central tower are best illustrated in FIGS. 12–18. FIG. 13 illustrates the top of leg 36*b* which provides a strut connector pole 48 and a sleeve landing shoulder 49 welded to the same leg 36*b* at the bottom of strut connector pole 48.

A strut connector sleeve 50 is connected t longitudinal members 44 at the top of the strut and is sized to fit over the strut connector pole 48, as shown in FIG. 12. In the preferred embodiment, sleeve landing shoulder 49 extends radially outwardly from the leg 36*b* a distance sufficient so that there may be misalignment between the pole 48 and the sleeve 50 of up to 10°. The upper face of landing shoulder 49 is machined so as to provide an upwardly-facing concave landing surface 53. See FIG. 13. Further, it is preferred that the lower end of sleeve 50 have a lower edge 79 which is machined to a curvature corresponding to the curvature of this concave landing surface. See FIGS. 14 and 16. Such complementary mating surfaces allow movement of the end of sleeve 50 on landing surface 53 of shoulder 49. Further, it may be desired to provide the machined lower edge 79 of sleeve 50 with a O-ring seal 54. See FIG. 16.

In a like manner an upper edge 56 of strut connector sleeve 50 may be machined to the same curve as the seating surface 57 of a seating shoulder 51. The seating shoulder 51 is welded at the bottom of leg 35*b* of the upper tower section 31. See FIG. 17. Thus, when the upper tower section 31 is lowered down into contact with the upper edge 56 of strut connector sleeve 50, the legs 35 of the upper tower section may be vertically positioned on the top of the strut connector sleeve which may be tilted somewhat on the landing shoulder 53 attached to the leg 36*b* of the lower tower section. See FIGS. 12 and 14.

The upper tower section 31 is fixedly secured to the lower tower section 32 in any suitable manner well known to the art. However, in the preferred embodiment, a connector pin 52 provided with a latching element 58 such as a split ring, secures the upper and lower tower sections together. See FIGS. 12 and 18. Connector pin 52 is received within leg 35*b* of the upper tower section and lowered into place between the upper and lower tower sections. Further, the outside diameter of connector pin 52 and the inside diameter of the leg provides an annular space which allows cement or grout 67 to be pumped between the pin and the leg to form a firm connection. Connector pin 52 (see FIG. 18) seats into neck 59 of the strut connector pole 48 (see FIG. 13). Neck 59 is provided on its internal surface with a groove 60 or other suitable means for engaging latching member 58 at the bottom of the pin as illustrated in FIG. 18. Thus, when latching member 58 expands into latching groove 60, the two are locked together as illustrated in FIG. 12.

It is preferred that the length of connector pins 52 exceed the height of upper tower section 31. Thus, the upper end of the pin extends above the top of the upper tower section and may be engaged by a suitable tensioning apparatus or member 61. Such tensioning members are well known to the art and are diagramatically represented in FIG. 1. The tensioning operation is accomplished prior to placing platform deck section 39 on the upper end of upper tower section 31. It is preferred to tension the connector pins so as to simultaneously pull seating shoulder 51 (FIG. 12) down on the top of the connector sleeve 50 to tightly land seating surface 57 upon upper edge 56 and pull lower edge 79 of the strut connector sleeve against sleeve landing shoulder 49 to tightly land lower edge 79 upon concave landing surface 53. Prior to tensioning the connector pins in the above described manner, there may be some tendency for connector sleeve 50 to come off of landing shoulder 49 upon which it was lowered. A suitable hold down latching device of any suitable type well known to the art may be employed in order to prevent this. The hold-down device, diagrammatically represented by a hydraulic packer 62 and gripping fingers 63, is secured to the outer surface of strut connector pole 48 (FIG. 13) so that the hold-down device fits between the outer surface of strut connector pole 48 and the inner surface of strut connector sleeve 50. Thus, packer 62 may be expanded against the inner wall of sleeve 50 to hold the sleeve down on sleeve landing shoulder 49. Alternatively, the packer may be carried on the strut connector sleeve and expand against the strut connector pole. The inner surface of strut connector sleeve 50 and the outer surface of pole 48 can also be provided with bar elements 64 and 65 to facilitate a stronger connection in the event cement is pumped into the annular space 66 between the strut connector pole and sleeve. In addition, grout or cement 67 can be injected into the space between the outer surface of the pin 52 and the inner surface of the leg **35*b*. After all the pins 52 had been tensioned, tensioning apparatus 61 (FIG. 1) would be removed before installing the deck section 39** of the platform.

In the preferred installation, strut connector sleeve 50 is placed over strut connector pole 48 and temporarily secured by hydraulic packer 62 interfacing with gripping fingers 63. Upper tower section 31 is then placed, connector pin 52 lowered, engaged, and tensioned. Then annular space 66 is grouted to form a secure, permanent connection.

Referring to FIG. 19 of the drawings, lower tower section 32 is shown during transport to an offshore location by means of a barge 87 on which it is mounted and one or more tug boats 68. At the launch site, lower tower section 32 is caused to slide off barge 87 into the water. The lower tower section is then upended in the water and precisely positioned at the selected location by towing it in a vertical position.

FIG. 20 shows lower tower section 32 being held in position by a pair of tugs 68 while being lowered by means of a derrick 70 on a derrick barge 71 in lowering operations well known to the art. Lower tower section 32 may be provided with one or more buoyancy tanks 69 which may be selectively flooded during the lowering operation.

After lower tower section 32 is positioned on the ocean floor as shown in FIG. 21, a pile 72 having a pile driver 73 connected to the upper end thereof, is lowered by means of a cable 74 from derrick barge 71 and stabbed into a pile sleeve 42 at the base of lower tower section 32. Pile 42 is then driven into ocean floor 33 in a manner well known to the art. This operation is repeated so as to drive a pile through each of the pile sleeves and grout it therein.

In FIG. 22, one bracing strut member of the platform, here strut **41*c*, is being towed to location on a barge 87 by a tug 68. At the offshore tower location, the strut is launched from the barge and towed to the derrick barge. Before the strut 41*c* is launched from the barge a pair of slings 75 and 75*a* are attached to the strut. The length of the slings 75 and 75*a* from the derrick barge 71 are adjusted so that the strut in the water assumes substantially the same angle that it will have when connected to lower tower section 32. Derrick barge 71 moves laterally so that strut connector sleeve 50 at the top of strut 41*c* is directly over strut connector pole 49 carried at the top of the leg of the lower tower. Strut 41*c* is then lowered by the slings 75 and 75*a* so that pole 49 stabs into sleeve 50 while the lower end of the strut is held slightly above the ocean floor. The hydraulic gripper or packer 62 or gripping fingers 63 (FIG. 13) will be actuated or set to engage the inner wall of sleeve 50 or a latching groove or element 76 formed on the inner wall thereof. See FIG. 14. Preferably, vertical pile 77 is driven through vertical pile sleeve 46 as shown in FIG. 24 prior to driving the batter piles through the other pile sleeves 47. In deepwater locations the lowering cable 74 may have lengths of a power cable 78** attached to it intermittently for support.

Figure 25:
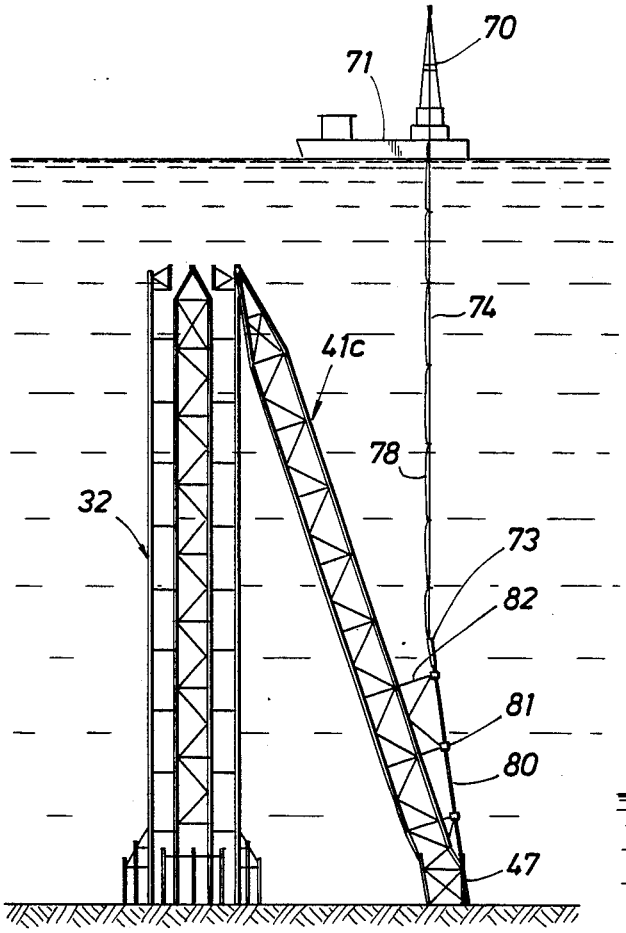
FIG. 25 is a diagrammatic view illustrating pile driving operations being carried out from a surface barge where batter piles are driven through the strut footings into the ocean floor.

In FIG. 25, a batter pile 80 is shown as being driven by pile driver 73 through a series of pile guides 81 attached to the ends of arms 82 which are provided to align the pile in line with the batter pile sleeve 47 through which the pile 80 is driven.

Figure 26:
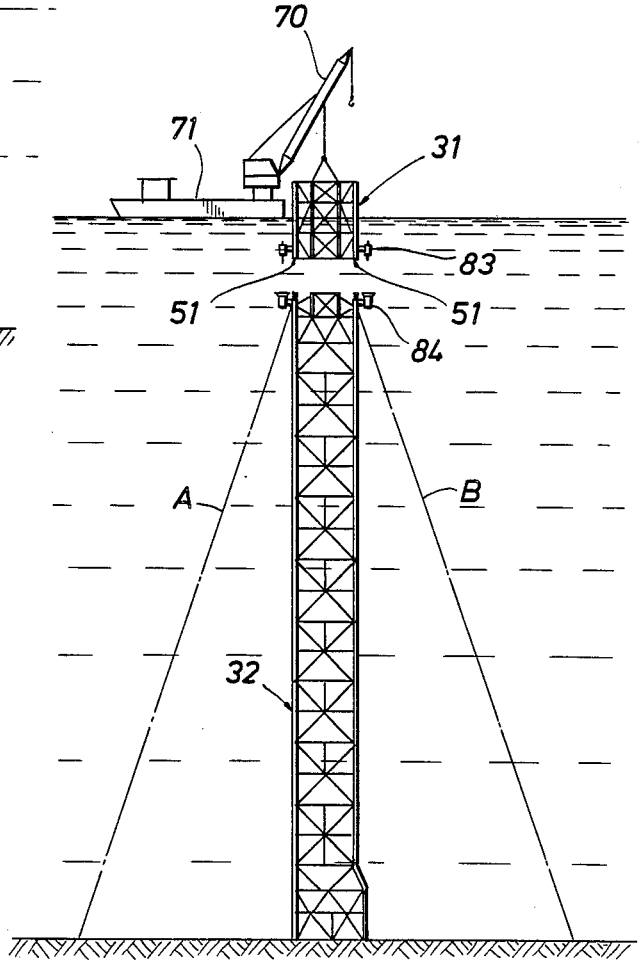
FIG. 26 is a diagrammatic view illustrating a derrick barge lowering an upper tower section of a platform onto the lower tower section in accordance with the present invention.

In FIG. 26, for ease of illustration, the previously placed struts have been omitted with lines A and B representing the center line of the support struts. Upper tower section 31 has been towed to location, off-loaded in the water, and connected to derrick 70 on derrick barge 71 which then positions upper tower section 31 directly over lower tower section 32. Preferably, docking poles 83 and docking sleeves 84 have been preinstalled outside the corners of the tower in a manner well known in the art to aid in aligning one tower section relative to the other when lowering the upper section. Upon lowering the upper section onto lower section 32, docking poles 83 stab into docking sleeves 84 to get a precise fit. At this time, seating shoulders 51 at the corners of upper tower unit 31 seat on the top of strut connector sleeves 50 in a manner previously described herein with respect to FIG. 12. Connector pins 52 are then run down through the legs of upper tower section 31 (see FIG. 12) and tentioning devices 61 (see FIG. 1) are installed to apply tension to the connector pins to pull upper tower section 31 onto lower tower section 32. The space between the connector pins and the legs and the annular space within the strut connector and the strut pole connector sleeves are cemented or grouted as previously described. Platform deck section 39 is then moved to the location and hoisted by means of derrick 70 of derrick barge 71 and then lowered onto the upper ends of upper tower unit 31. It would be connected to the upper unit in a suitable manner, as by welding.

Thus, it may be seen that the present invention provides a method for transporting a two-section offshore platform to a selected offshore location, anchoring the lower section of the platform to the ocean floor, transporting and installing bracing struts through the lower section of the platform while anchoring the lower ends of the struts to the ocean floor. A stab type connector sleeve is provided at the top of each strut to stab over a connector pole at the top of the leg of the lower platform section and subsequently lowering the upper section onto the connector at the ends of the struts then connecting the upper and lower sections of the platform together underwater.

It is an object of the present invention to try and get the optimum support point for the tower in order to get good dynamic characteristics for the tower. It is important to try and get the natural period of the platform well below the period of the waves. While the present invention has been described with regard to a tower in 2,000 feet of water with the bracing struts attached at the −200-foot depth, the −200-foot connection point may be varied over a considerable range depending upon the characteristics of the tower and the location offshore of the platform. Generally, it is desirable to select a connection point not too deep so that, if something goes wrong with the installation, divers can be sent down in an attempt to solve the problem. In selecting a connection point for the struts, some consideration has been given to the equipment available for installing a very large upper tower section. For example, few derrick barges have means for installing one underwater deeper than 400 feet.

Other modifications, changes and substitutions are intended in the foregoing disclosure and in some instances, some features of the invention will be employed without a corresponding use of other features. Accordingly, it is appropriate that the appended claims be construed broadly and in a manner consistent with the spirit and scope of the invention herein.

What is claimed is:

1. An offshore platform for hydrocarbon drilling and production operations, said platform being bottom-founded upon the ocean floor and extending above the ocean surface and comprising:

a central tower having a plurality of legs extending from the ocean floor to above the ocean surface, said central tower comprising:

a bottom-founded lower tower section extending the major portion of the height of the central tower, but extending less than the ocean surface;

an upper tower section connected to the lower tower section and extending above the surface of the water; and means for connecting the upper tower section to the lower tower section, comprising:

a strut connector pole extending upwardly from each of the plurality of the legs of the lower tower section; and a connector pin extending downwardly from each of a plurality of legs of the upper tower section which engages the strut connector poles of the lower tower section;

a plurality of elongated reinforcing struts, each comprising:

a footing on the lower end of the reinforcing strut;

pile sleeves connected to the footing;

piles extending through the pile sleeves and anchored into the ocean floor; and a strut connector sleeve on the upper end of the reinforcing strut; and means for connecting the strut connector sleeve of the reinforcing strut to the central tower, comprising:

a sleeve-landing shoulder on each of a plurality of legs of the lower tower section immediately below the strut connector pole of said leg, said sleeve-landing shoulder receiving the strut connector sleeve in a supporting manner; and a seating surface on each of a plurality of legs of the upper tower section immediately above the connector pin of said leg, said seating surface engaging the top of the strut connector sleeve and securing the reception of the strut connector sleeve around the strut connector pole between the sleeve-landing shoulder and the seating surface; and a platform deck section supported by the central tower.

2. An offshore platform in accordance with claim 1 wherein the strut connector pole is hollow and the means for connecting the upper tower section to the lower tower section further comprises:

an interiorly circumferential latching groove within the strut connector pole; and an exteriorly circumferential latching member carried on the connector pin disposed for locking engagement within the latching groove.

3. An offshore platform in accordance with claim 2 wherein the means for connecting the upper tower section to the lower tower section further comprises a grout set in the annulus between the joined strut connector pole and connector pin and the strut connector sleeve.

4. An offshore platform in accordance with claim 1 wherein the sleeve-landing shoulder has an upwardly facing concave landing surface.

5. An offshore platform in accordance with claim 4 wherein the strut connector sleeve has a machined lower edge and an O-ring seated therein disposed in sealing relationship with the upwardly facing concave landing surface.

6. An offshore platform in accordance with claim 5 wherein the seating surface has a downwardly concave seating shoulder.

7. An offshore platform in accordance with claim 6 wherein the strut connector sleeve has a machined upper edge and an O-ring seated therein disposed in sealing relationship with the downwardly concave seating shoulder.

8. An offshore platform in accordance with claim 1 wherein means for connecting the strut connector sleeve to the central tower further comprises a hydraulic packer disposed circumferentially about the strut connector pile within the strut connector sleeve and disposed for expansion within an annular space therebetween to temporarily secure the engagement of the strut connector sleeve upon the strut connector pole.

9. An offshore platform in accordance with claim 8 wherein the means for connecting the strut connector sleeve to the central tower further comprises a plurality of gripping fingers disposed circumferentially about the strut connector pole and disposed for gripping engagement between the strut connector pole and the strut connector sleeve.

10. An offshore platform in accordance with claim 9 wherein the means for connecting the strut connector sleeve to the central tower further comprises a grout set between the strut connector sleeve and the strut connector pole.

11. An offshore platform in accordance with claim 1 wherein the connector pins extend the full length of the upper tower section to emerge from the legs of the upper tower section to be received within a tensioning apparatus temporarily mounted on the platform deck section.

12. A method of constructing an offshore platform, comprising:

installing a bottom-founded lower tower section at an offshore site;

installing a plurality of elongated struts onto strut connector poles presented at the upper end of a plurality of legs presented by the lower tower section, each installation comprising:

lowering the strut from a surface barge in a plurality of slings such that the angle of the strut is substantially at the installed inclination;

stabbing a strut connector sleeve at the top end of the strut over the strut connector pole and sliding it downwardly thereon until the strut connector sleeve rests on a sleeve-landing shoulder;

securing a footing at the lower end of the strut to the ocean floor by driving a pile through each of a plurality of pile sleeves connected to the footing and grouting the pile sleeves to the piles;

installing the upper tower section onto the lower tower section and securing the strut connector sleeve in place, comprising:

landing a plurality of seating shoulders depending from a plurality of legs presented by an upper tower section onto an upper edge of the strut connector sleeve; and engaging a connector pin within the legs of the upper tower section and the strut connector pole;

whereby the strut connector sleeve surrounds the engagement of the strut connector pole and the connecting pin and the strut connector sleeve is secured between the seating surfaces of the upper tower section and the sleeve landing shoulder of the lower tower section;

installing a platform deck section upon the upper tower section.

13. A method of constructing an offshore platform in accordance with claim 12 wherein installing the upper tower section onto the lower tower section and securing the strut connector sleeve in place further comprises injecting and setting a grout in an annulus between the joined strut connector pole and the connector pin and the interior of the surrounding strut connector sleeve.

14. A method of constructing an offshore platform in accordance with claim 12 wherein installing the upper tower section onto the lower tower section and securing the strut connector sleeve in place further comprises securing the connector pin to the strut connector pole in a manner resistive to axial tension and applying force across the seating surface to strut connector sleeve to sleeve landing shoulder as a result of tension applied to the connector pin from the platform deck section through a tensioning assembly.

15. An offshore platform for supporting deepwater marine oil field drilling and production equipment, said platform comprising:

a central tower having a plurality of legs extending from the ocean floor to above the surface of the water;

the major portion of said tower forming a lower tower section with a shorter upper tower section adapted to be connected to the lower tower section, said sections being rectangular when taken in cross-section;

a plurality of reinforcing lattice framework struts extending from the corner legs of said lower tower section from the top thereof at a selected angle outwardly and downwardly from said tower section;

strut-to-tower leg connector means for connecting each of said struts to the top of a leg of the lower tower section and for operatively connecting each of said legs to the bottom of the leg of the upper tower section directly above;

said connector means comprising a connector pole at the top of each leg to be connected to a strut;

landing shoulder means carried on said pole and extending outwardly therefrom, said shoulder means having an upwardly facing concave landing surface;

seating shoulder means carried at the lower end of the above adjacent leg of upper tower section, said shoulder means having a downwardly facing concave seating surface;

a tubular strut connector sleeve carried at the end of each strut and being of an internal diameter to fit over said connector pole in spaced relationship therewith to form an annular space therebetween whereby the axes of the pole and the sleeve may be offset to form an angle of up to 10° while the sleeve is positioned between said landing shoulder means and said seating shoulder means;

said upper and lower end surfaces of said tubular strut connector sleeve being formed with substantially the same curve as the mating concave surfaces of said landing shoulder means and said seating shoulder means normally in contact therewith;

elongated pin means adapted to pass through a leg of the upper tower section in spaced relationship therewith to form an annular space and to engage the upper end of the connector pole;

connector means for connecting the lower end of the pin means to the connector pole; and said central tower and said struts thereof having pile sleeves affixed thereto to accommodate piles for anchoring the platform to the ocean floor.

16. The apparatus of claim 15 including hold-down anchoring means between said connector pole and said connector sleeve for holding the sleeve down on the landing shoulder means of the pole when it has been stabbed on the pole.

17. The apparatus of claim 15 including concrete in the annular space between the elongated pin means and the surrounding leg of the upper tower section.

18. The apparatus of claim 15 including a deck section anchored to the top of the upper tower section.

19. The apparatus of claim 15 including tensioning means operatively engagable with the elongated pin means and the upper tower section.

20. The apparatus of claim 15 including an anchoring footing at the base of each bracing strut, said footing including at least one vertical pile sleeve and a plurality of battered pile sleeves.

21. A method of installing a strut-braced offshore platform made up of a central tower having upper and lower tower sections with bracing struts extending from the top of the legs of the lower tower section outwardly and downwardly to the ocean floor, said method comprising the steps of:

transporting the lower tower section to a selected offshore location;

upending the lower tower section in the water and lowering it to the ocean floor;

anchoring the lower tower section to the ocean floor, said tower being provided with a connector pole at the upper end of each leg;

transporting the bracing struts one at a time to the tower location where the upper end of the lower tower section is below the surface of the water, each strut having a connector sleeve at its upper end;

lowering each strut from a barge on slings holding it at substantially the angle it will assume in its final position against the tower and the ocean floor;

stabbing the connector sleeve at the top of each strut over a connector pole at the top of one leg of the lower tower section and continuing lowering the strut until its upper end is fixedly positioned relative to the lower tower section and its lower end rests on the ocean floor;

anchoring the lower end of each of the struts to the ocean floor;

lowering the upper tower section on to the connector sleeves of the struts at the top of the lower tower section below the surface of the water; and connecting the upper and lower tower sections together.

22. The method of claim 21 wherein the step of connecting the upper and lower tower sections together includes the steps of:

lowering a connector pin through each leg of the upper tower section and into the connector sleeve positioned therebelow; and connecting the bottom of each connector pin to the connector pole it contacts.

23. The method of claim 22 including (he step of pump grout into the annular space between each connector pin and the surrounding leg of the upper tower section.

24. The method of claim 23 including the step of applying tension to each connector pin to pull the upper tower section tightly against the connector sleeve and connector pole prior to grouting.

25. The method of claim 24 including the step of installing a deck section of the platform to the top of the tower.

* * * * *